US005826563A

United States Patent [19]

Patel et al.

[11] Patent Number: 5,826,563

[45] Date of Patent: Oct. 27, 1998

[54] DIESEL ENGINE CYLINDER SKIP FIRING SYSTEM

[75] Inventors: Sagar Arvindbhai Patel; Rocco Volpe, Jr., both of Erie, Pa.

[73] Assignee: General Electric Company, Erie, Pa.

[21] Appl. No.: 901,747

[22] Filed: Jul. 28, 1997

[51] Int. Cl.[6] ..... F02D 17/02

[52] U.S. Cl. ..... 123/481; 123/198 F

[58] Field of Search ..... 122/198 F, 481

[56] References Cited

U.S. PATENT DOCUMENTS

| | | | |
|---|---|---|---|
| 4,172,434 | 10/1979 | Coles | 123/481 |
| 4,207,855 | 6/1980 | Phillips | 123/198 F |
| 4,509,488 | 4/1985 | Forster et al. | 123/481 |
| 4,550,704 | 11/1985 | Barho et al. | 123/481 |
| 4,552,114 | 11/1985 | Sano et al. | 123/481 |
| 4,640,241 | 2/1987 | Matsunaga | 123/198 F |
| 4,655,187 | 4/1987 | Gravestock | 123/481 |
| 4,768,474 | 9/1988 | Fujimoto et al. | 123/481 X |
| 4,991,558 | 2/1991 | Daly et al. | 123/481 |
| 5,408,974 | 4/1995 | Lipinski et al. | 123/481 |
| 5,438,968 | 8/1995 | Johnson et al. | 123/481 X |
| 5,553,575 | 9/1996 | Beck et al. | 123/198 F |
| 5,645,032 | 7/1997 | Motose | 123/481 X |
| 5,720,257 | 2/1998 | Motose et al. | 123/481 X |

*Primary Examiner*—Tony M. Argenbright
*Attorney, Agent, or Firm*—Jill M. Breedlove; Marvin Snyder

[57] ABSTRACT

A high horsepower diesel engine is operated in a skip firing mode in which the engine includes a plurality of individually controllable, fuel injected cylinders. The system senses that the engine is operating in a low horsepower mode and has a low fuel demand and thereafter selects a firing pattern of cylinders to be fired during each revolution of the engine crankshaft based upon the values of the sensed fuel demand and engine horsepower. The pattern selected for firing the cylinders is arranged such that all cylinders of the engine are fired within a preselected number of crankshaft rotations. The system also senses the engine air-fuel ratio and adjusts the pattern of cylinders being fired so as to maintain exhaust emissions below a preselected level. Additionally, the pattern of fired cylinders may be adjusted to maintain engine operating temperature and as a function of engine speed.

20 Claims, 5 Drawing Sheets

TABLE 1. 16-Cylinder Sequences
45 crank deg betn cylinders 1R-1L-3R-3L-7R-7L-4R-4L-
8R-8L-6R-6L-2R-2L-5R-5L TABLE 2. 8-Cylinder Sequences
90 crank deg betn cylinders 1R-3R-7R-4R-8R-6R-2R-5R-
1L-3L-7L-4L-8L-6L-2L-5L TABLE 3. 5,6-Cylinder Sequences
135 crank deg betn cylinders 1R-3L-4R-8L-2R-5L
3R-7L-8R-6L-5R
1L-7R-4L-6R-2L TABLE 4. 4-Cylinder Sequences
180 crank deg betn cylinders 1R-7R-8R-2R
1L-7L-8L-2L
3R-4R-6R-5R
3L-4L-6L-5L

74

SKIP FIRING
TABLE POINTER

DIESEL ENGINE CYLINDER SKIP FIRING SYSTEM

BACKGROUND OF THE INVENTION

This invention relates generally to operation of diesel engines in traction vehicles such as locomotives and relates more particularly to fuel control of diesel engines to improve efficiency and reduce emissions.

Large self-propelled traction vehicles such as locomotives commonly use a diesel engine to drive an electrical transmission comprising generating means for supplying electric current to a plurality of direct current (dc) traction motors whose rotors are drivingly coupled through speed-reducing gearing to the respective axle-wheel sets of the vehicle. The generating means typically comprises a main 3-phase traction alternator whose rotor is mechanically coupled to the output shaft of the engine (typically a 16-cylinder turbocharged diesel engine). When excitation current is supplied to field windings on the rotating rotor, alternating voltages are generated in the 3-phase stator windings of the alternator. These voltages are rectified and applied to the armature windings of the traction motors.

During the "motoring" or propulsion mode of operation, a locomotive diesel engine tends to deliver constant power, depending on throttle setting and ambient conditions, regardless of locomotive speed. For maximum performance, the electrical power output of the traction alternator must be suitably controlled so that the locomotive utilizes full engine power. For proper train handling, intermediate power output levels are provided to permit graduation from minimum to full output. But the load on the engine must not exceed whatever level of power the engine can develop. Overloads can cause premature wear, engine stalling or "bogging," or other undesirable effects. Historically, locomotive control systems have been designed so that the operator can select the desired level of traction power, in discrete steps between zero and maximum, so that the engine develops whatever level of power the traction and auxiliary loads demand.

Engine horsepower is proportional to the product of the angular velocity at which the crankshaft turns and the torque opposing such motion. For the purpose of varying and regulating the amount of available power, it is common practice to equip a locomotive engine with a speed regulating governor which adjusts the quantity of pressurized diesel fuel (i.e., fuel oil) injected into each of the engine cylinders so that the actual speed (RPM) of the crankshaft corresponds to a desired speed. The desired speed is set, within permissible limits, by a manually operated lever or handle of a throttle that can be selectively moved in eight steps or "notches" between a low power position (N1) and a maximum power position (N8). The throttle handle is part of the control console located in the operator's cab of the locomotive. In addition to the eight conventional power notches, the handle has an "idle" position.

The position of the throttle handle determines the engine speed setting of the associated governor. In a typical electronic fuel injection governor system, the output excitation from a controller drives individual fuel injection pumps for each cylinder allowing the controller to individually control start of and duration of fuel injection for each cylinder. The governor compares the desired speed (as commanded by the throttle) with the actual speed of the engine, and it outputs signals to the controller to set fuel injection timing to minimize any deviation therebetween.

For each of its eight different speed settings, the engine is capable of developing a corresponding constant amount of horsepower (assuming maximum output torque). When the throttle notch 8 is selected, maximum speed (e.g., 1,050 rpm) and maximum rated gross horsepower (e.g., 4,000) are realized. Under normal conditions, the engine power at each notch equals the power demanded by the electric propulsion system which is supplied by the engine-driven main alternator plus power consumed by certain electrically and mechanically driven auxiliary equipment.

The output power (KVA) of the main alternator is proportional to the product of the rms magnitudes of generated voltage and load current. The voltage magnitude varies with the rotational speed of the engine, and it is also a function of the magnitude of excitation current in the alternator field windings. For the purpose of accurately controlling and regulating the amount of power supplied to the electric load circuit, it is common practice to adjust the field strength of the traction alternator to compensate for load changes (traction motor loading and/or auxiliary loading) and minimize the error between actual and desired KVA. The desired power depends on the specific speed setting of the engine. Such excitation control will establish a balanced steady-state condition which results in a substantially constant, optimum electrical power output for each position of the throttle handle.

The above-summarized locomotive in practice will often be at rest with its engine running, its throttle in idle position, and its main alternator developing no power (i.e., zero traction load). The regular idle speed of a locomotive engine is usually high enough to enable all engine-driven auxiliary equipment to function properly if operative while the locomotive is at rest. More particularly, it is high enough to assure that the pressure in the engine cooling system (which includes an engine- driven water pump and a plurality of radiators) is sufficient to circulate the coolant through the radiators if required. A regular idle speed of approximately 440 rpm is typical.

To conserve fuel while the locomotive is at rest with the engine idling, it is a known practice to reduce engine speed below the aforesaid regular idle setting (e.g., to a preselected "low idle" speed such as 335 rpm) so long as the engine coolant is relatively warm. But if the temperature of the coolant were to drop below a predetermined low limit (e.g., approximately 140° F.), the engine is automatically returned to its regular idle speed, thereby producing more heat. Persons skilled in the art will understand that the operating temperature of a diesel engine needs to be above some minimum point for two different reasons: (1) engine fuel consumption, at any given idle speed, tends to vary inversely with temperature (increasing approximately 7% for each 10° F. decrement in a 16-cylinder, 4,000 horsepower engine); and (2) sulfur in the fuel tends to corrode the engine cylinder liners at an unacceptably rapid rate when the coolant temperature is too low. Corrosive liner wear can be controlled by running the engine at a higher idle speed and/or by adding electric heaters so as to warm up the engine coolant. Since fuel consumption increases with engine speed, it is obviously desirable to minimize the time during which the engine has to idle at more than the low idle speed.

While low idle speed conserves fuel and reduces overall stress on an engine, actual fuel efficiency drops when an engine operates below some optimal speed and load conditions. Fuel efficiency refers to the percentage of fuel actually burned in any quantity of fuel injected into an engine cylinder. Poor fuel efficiency is evident by visible exhaust emissions and by build-up of carbon deposits in the cylinders.

SUMMARY OF THE INVENTION

The present invention provides a method and system for more efficient operation of an internal combustion engine;

for reducing visible exhaust emissions for a high-horsepower multi-cylinder engine under idling conditions; for implementing skip firing of cylinders in a multi-cylinder engine; and for minimizing engine bogging during idle conditions with skip firing.

In an illustrative embodiment, the invention is described in conjunction with a high-horsepower, turbocharged diesel engine powering a diesel electric locomotive. An engine control unit monitors engine speed and controls the volume of fuel to the engine so as to maintain engine speed at a desired speed. The control unit computes any engine speed error and adjusts fuel value to compensate. Based on engine speed, the control unit determines how many of the engine cylinders can be skipped, i.e., not fueled, in any engine shaft rotation without causing the engine to speed bog or produce excessive exhaust emission. Within such limits, the control unit computes the minimum number of cylinders which can be fired and produce the required horsepower to maintain locomotive functions. Given the number of cylinders to be fired in any shaft revolution, the control unit selects a pattern of cylinder firings that will fire the desired number of cylinders per revolution and will fire all cylinders in successive revolutions.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
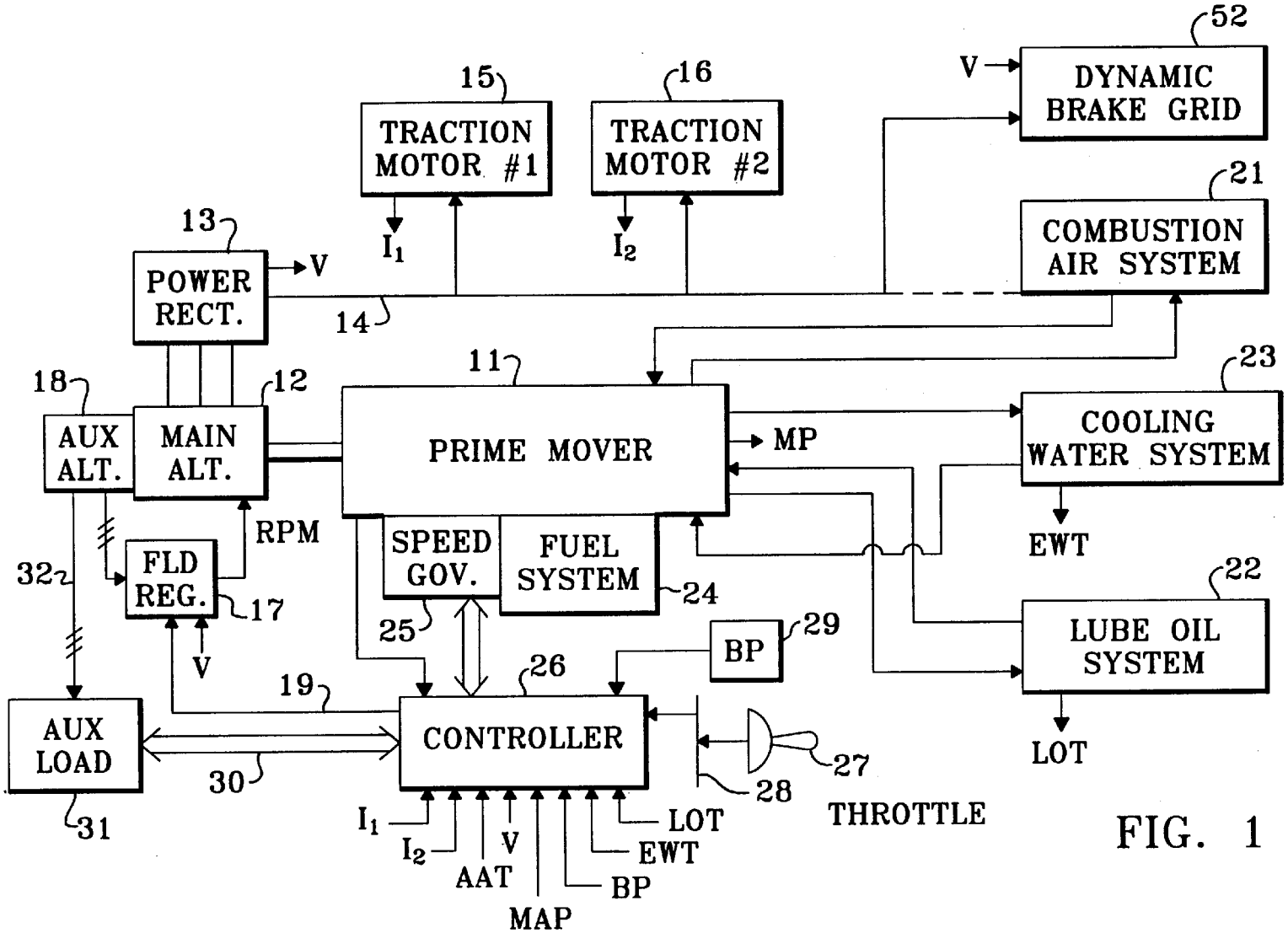
FIG. 1 is a schematic diagram of the principal components of a locomotive system, including a thermal prime mover (such as a diesel engine), a traction alternator, a plurality of traction motors, auxiliary load equipment, and a controller.

Referring now to FIG. 1, there is shown a simplified functional block diagram of a locomotive propulsion system including a variable speed prime mover 11 mechanically coupled to drive a three-phase alternating current (AC) synchronous generator 12, also referred to as a main traction alternator. The three-phase voltages generated by the alternator 12 are applied to AC input terminals of at least one three-phase, bi-directional uncontrolled power rectifier bridge 13. In the illustrated system, the locomotive utilizes DC traction motors 15 and 16 for driving the wheels of the locomotive. In such a case, the rectified electric power output of the bridge 13 is supplied via a DC bus 14 to the parallel connected armature windings of the traction motors 15, 16. While only two motors, 15 and 16 are shown, in practice, a traction motor is supplied for each axle of a locomotive and there are typically two to three axles per truck with two trucks per locomotive so that a conventional locomotive may have from four to six traction motors. If the traction motors are AC rather than DC motors, the DC bus 14 is typically connected to a controlled inverter (not shown) which supplies variable frequency power to the AC motors.

The prime mover 11 is a thermal or internal combustion engine and is typically a high horsepower, turbocharged, four stroke, 16 cylinder diesel engine. Such an engine has a number of ancillary systems that are represented by the labeled blocks in FIG. 1. A combustion air system 21 conventionally includes an engine exhaust gas driven turbocharger for compressing air in the combustion air intake manifold of the engine. A lube oil system 22 conventionally includes an engine crankshaft driven pump and associated piping for supplying suitable lubricating oil to the various moving parts of the engine. A cooling water system 23 conventionally includes a pump for circulating relatively cool water from a plurality of air cooled heat exchangers or radiators to a lube oil cooler, to the cylinder liners of the engine for absorbing heat rejected during the combustion process, and also to intercoolers through which the combustion air passes after being compressed by the turbocharger. Still further, the diesel engine includes a fuel system 24 comprising a fuel tank, fuel pumps and nozzles for injecting fuel oil into the respective power cylinders which are arranged in two rows or banks on opposite sides of the engine. Tappet rods cooperate with fuel cams on a pair of camshafts for actuating the respective fuel injectors at the proper times during each full turn of the engine camshaft. The electronic fuel injector controller then controls start of and duration of fuel flow into a cylinder each time the associated injector is actuated. The excitation of each fuel pump solenoid, and hence the quantity of fuel that is being supplied to the engine, is controlled by output signals from the engine speed governor system 25. While shown separately, the electronic fuel controller governor 25 is incorporated in the controller 26. The governor regulates engine speed by automatically controlling fuel flow within predetermined limits in a direction and by an amount that minimizes any difference between actual and desired speeds of the engine crankshaft. The desired speed is set by a variable speed control signal received from a controller 26, which signal is herein called a speed command signal or speed call signal.

In a normal motoring or propulsion mode of operation, the value of the engine speed call signal provided by the controller 26 is determined by the position of a handle 27 of a manually operated throttle to which the controller is coupled. A locomotive throttle conventionally has eight power positions or notches (N), plus idle. N1 corresponds to the minimum desired engine speed or power, while N8 corresponds to maximum speed and full power. In a consist of two or more locomotives, only the lead unit is usually attended and the controller on board each trail unit will receive, over a train line 28, an encoded signal that indicates throttle position selected by the operator in the lead unit.

For each power level of the engine there is a corresponding desired load. The controller 26 is arranged to translate the throttle notch information into a control signal of appropriate magnitude on the input line 19 of the alternator field regulator 17, whereby the traction power is regulated to match the called-for power so long as the alternator output voltage and load current are both within predetermined limits. For this purpose, it is necessary to supply the controller 26 with information about various operating conditions and parameters of the propulsion system, including the engine and its support systems. More particularly, the controller 26 typically receives voltage and current feedback signals representative of the power supplied to the traction motors and a load control signal issued by the governor system 25 if the engine cannot develop the power demanded and still maintain the called-for speed. The controller also receives an engine speed signal RPM indicating the rotational speed of the engine crankshaft and ambient air pressure signal BP from a barometric pressure sensor 29, an intake manifold air pressure signal MAP from a pressure sensor associated with an air intake manifold at the engine, and oil temperature signal LOT from a temperature sensor on the hot oil side of the lube oil cooler, and a water temperature signal EWT from a temperature sensor in a hot water section of the cooling water system 23 and an ambient air temperature signal AAT from an appropriate temperature sensor. The controller uses the signal EWT to control radiator fan motors that control the flow of air across the heat exchange tubes of the radiators so as to maintain a relatively constant engine operating temperature over the load range of the engine and with wide variations in ambient temperature.

The above listing is representative of the signals which are applied to the controller 26 to enable the controller to properly set the fuel control to the engine 11 so as to regulate the power output of the engine to meet the requirements of the locomotive and any auxiliary equipment coupled to the locomotive. While each cylinder of the engine has its own individually controllable fuel injector, typical operation of the engine is to supply the same control signal from the controller 26 to each fuel injector such that the amount of fuel injected into each cylinder of the engine is the same for each cylinder.

The present invention utilizes the capability of individual fuel injector control to inhibit fuel injection into selected cylinders of the engine during low power operation so as to implement a "skip firing" protocol, i.e., a cylinder firing protocol in which only selected cylinders are fired during each revolution of the engine cam shaft.

Figure 2:
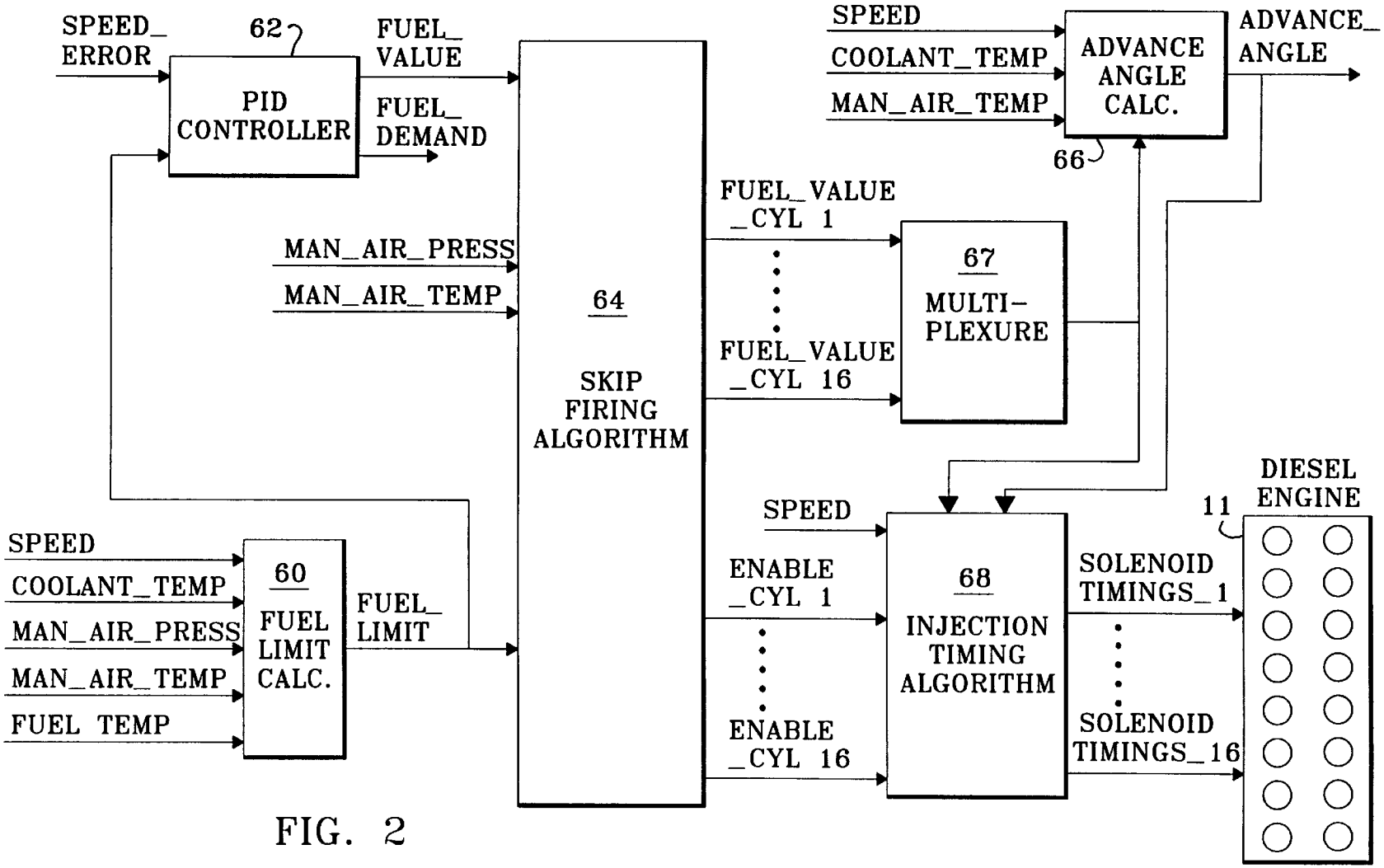
FIG. 2 is a functional block diagram of a control scheme for a diesel engine with which the present invention may be used.

Turning now to FIG. 2, there is shown a functional block diagram of a fuel control system for a 16 cylinder diesel engine incorporating the skip firing method according to a preferred embodiment of the present invention. Typically, the engine fueling system for a locomotive includes an active fuel limit calculation function indicated at block 60 which uses measured values of speed (RPM), coolant temperature (EWT), manifold air pressure (MAP), manifold air temperature (MAT) and fuel temperature to calculate a maximum volume of fuel flow for the measured conditions. Calculation of fuel limit indicated by block 60 is known in the locomotive art. The fuel limit value is applied to a proportional plus integral/derivative (PID) controller 62 and is used therein to limit the fuel value (FV) command, i.e., the command which sets the volume of fuel to be injected into each cylinder in each cycle.

Controller 62 is a conventional PI controller with a limiter responsive to the fuel limit signal. The primary input to controller 62 is a speed error signal representing the difference between commanded speed of the locomotive and actual speed. The output of controller 62 is the fuel value signal FV and is supplied to block 64 representing the functional software which determines if skip firing is an option. The fuel limit signal along with the MAT and MAP signals are also operated on by the software block 64. As will be appreciated, controller 26 represents multiple process controllers arranged in a hierarchal or distributed combination. The actual implementation of firing control as herein described may be in a microprocessor and associated memory dedicated to the fuel system 24 so that block 64 represents a program stored in such memory and operable in such processor.

The signals developed by block 64 include fuel value commands for each engine cylinder (Fuel_value_cyl1 through Fuel_value_cyl16) and fuel injection start commands for each cylinder (Enable_cyl1 through Enable_cyl16). Control of the Enable_cyl signals allows implementation of skip firing. The fuel value commands are applied to an advance angle calculator block 66 via a multiplexer 67 which computes the advance angle, i.e., time at which fuel injection starts with respect to a top dead center (TDC) position of an associated piston. The calculation also includes use of the signals representative of engine speed, coolant temperature and manifold air pressure. The calculation of advance angle is known in the art. The advance angle signal (or data) is used in an injection timing computation to develop signals for actuating fuel solenoids in fuel system 24 (FIG. 1) at appropriate times with respect to TDC position of each piston.

Injection timing block 68 represents the computation of signals for fuel solenoid control. Block 68 also receives the "skip firing" commands, i.e., the enable cylinder command signals from block 64 which specify which solenoids are to be operated for supplying fuel to an associated cylinder. The injection timing block 68 exists in available locomotives but without the enable cylinder function which implements skip firing.

Figure 3A:
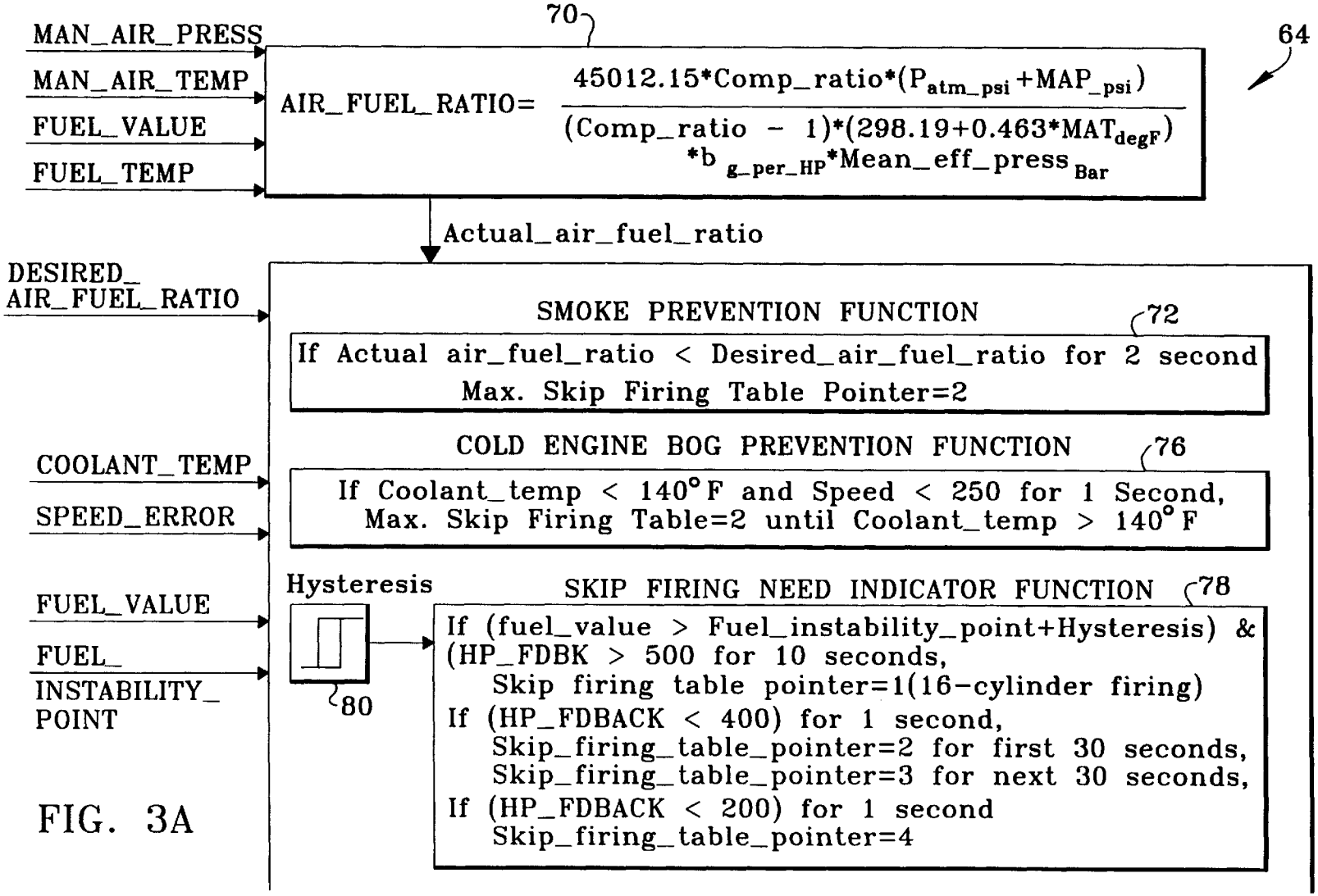
FIGS. 3A, 3B and 3C together comprise is a functional block diagram of a skip firing method in accordance with a preferred embodiment of the present invention
Figure 3B:
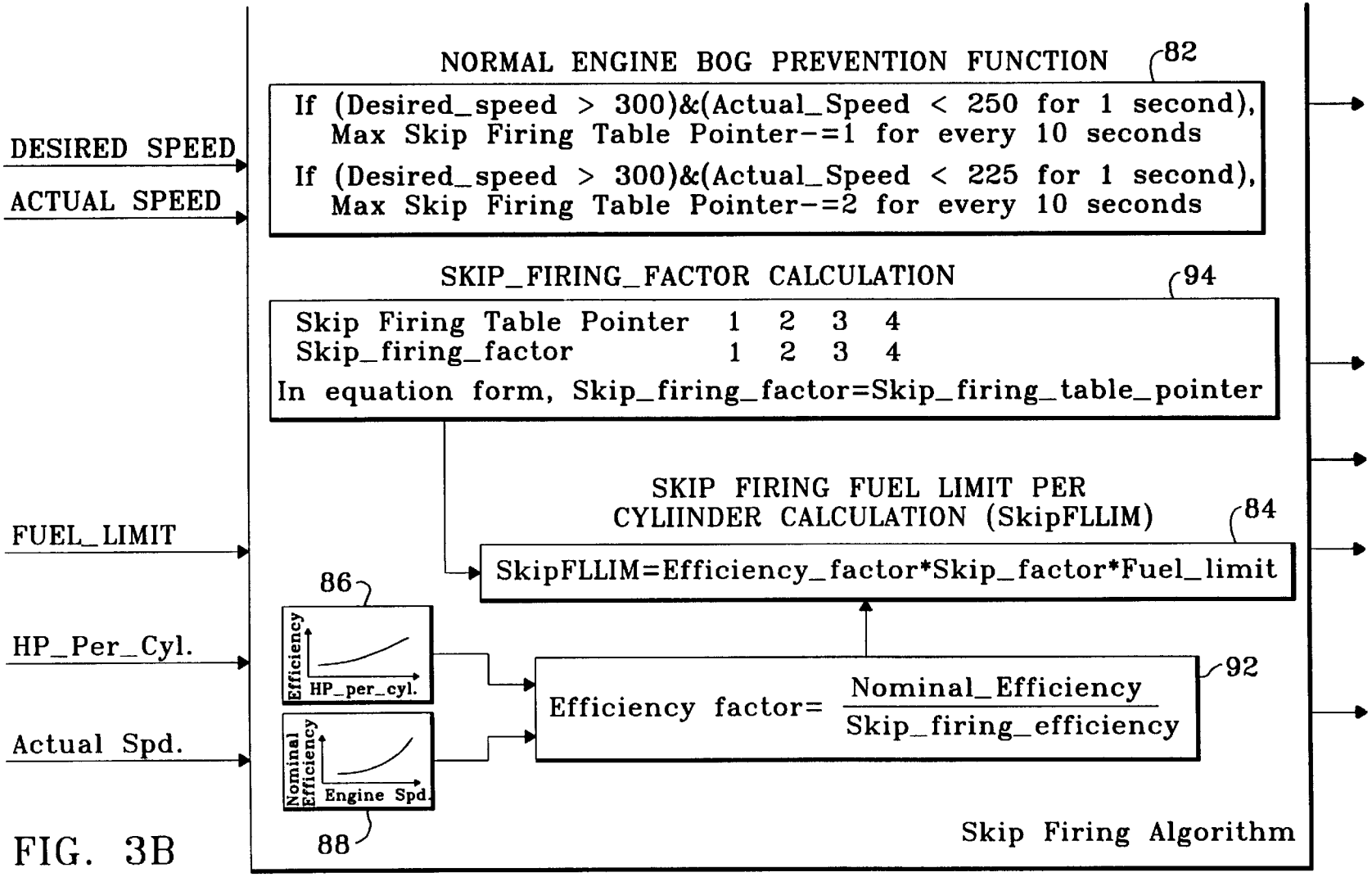
Figure 3:
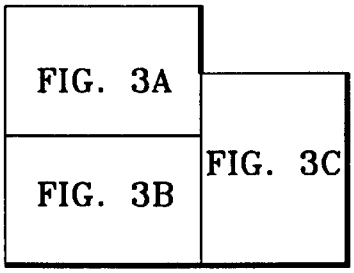
FIG. 3 illustrates the arrangement of FIDS. 3A, 3B, and 3C.
Figure 3C:
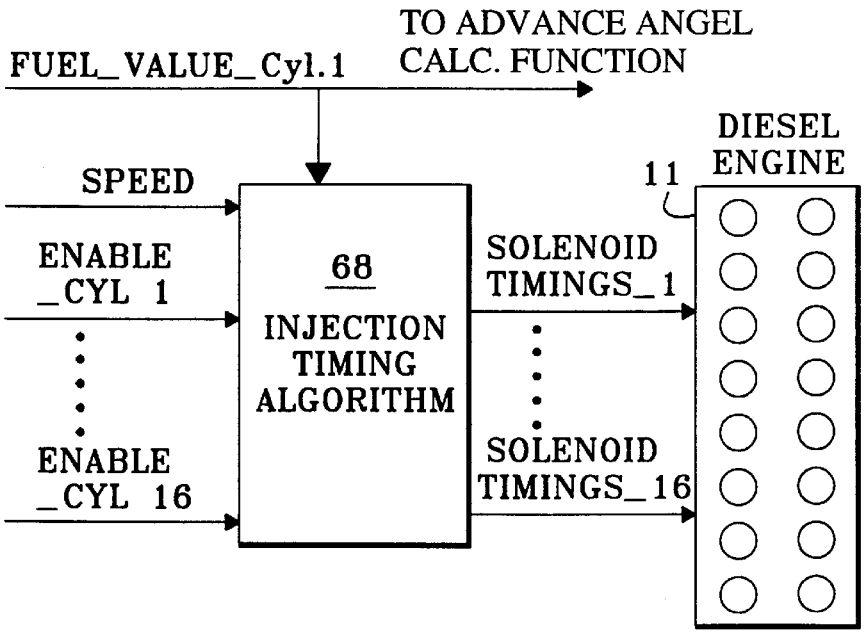

Referring now to FIGS. 3A, 3B and 3C there is shown an expanded functional block diagram of the skip firing block 64 of FIG. 2. Beginning at the upper left of FIG. 3, the input signals MAP, MAT, FV and fuel temperature are utilized to calculate an actual air-fuel ratio for the diesel engine 11. The calculation is based on the equation shown in block 70, namely $$\text{Air_Fuel_Ratio} = \frac{45012.15*CR*(P+MAP)}{(CR-1)+(298.19+0.463+MAT)*b*MEP}$$

where CR is the engine compression ratio; P is atmospheric pressure in psi; MAP is manifold air pressure in psi; MAT is manifold air temperature in degrees F; b is specific fuel consumption in gallons per horsepower; and MEP is mean effective barometric pressure.

The calculated air-fuel ratio is used as part of a smoke prevention function indicated by block 72. In particular, the calculated actual air-fuel ratio is compared to a desired air-fuel ratio, where the desired air-fuel ratio is selected to minimize visible exhaust emissions. In block 72, the actual air-fuel ratio is compared to the desired air-fuel ratio and if the actual air-fuel ratio is less than the desired air-fuel ratio for any 2 second interval, the max skip firing table pointer is limited to Table 2. The skip firing tables are indicated at block 74 and contain a sequence of firings of each of the cylinders in the diesel engine 11 for various firing protocols. Table 1 is the firing sequence if all 16 cylinders are fired. Note that in the 16 cylinder diesel engine, each rotation of the cam shaft corresponds to two full rotations of the engine drive shaft. Accordingly, in a single drive shaft rotation, only 8 cylinders would be fired with the remaining 8 cylinders being fired on the second shaft rotation. However, a single rotation of the cam shaft would fire all 16 cylinders. Accordingly, the 45 crank degrees between cylinders refers to the crank angle of the crank or drive shaft and not the cam shaft. Table 2 is the sequence of firing for 8 cylinders per cam shaft rotation and indicates the pattern if there is a 90 crankshaft angle between cylinder firings. Note that all cylinders are listed in Table 2 but that firing would actually require four revolutions of the crankshaft before all 16 cylinders are fired. Similarly, Table 3 shows the sequence of firing for 135 crankshaft degrees between cylinders. Because of the even number of cylinders, the first two revolutions of the crankshaft requires a firing of six cylinders whereas the next two revolutions requires five cylinders followed by five cylinders in the subsequent two revolutions. Finally, Table 4 illustrates the firing sequence for 180 crank angle degrees between cylinders. In the sequence of FIG. 4, only four cylinders are fired in two complete revolutions of the crankshaft or two cylinders are fired in one revolution of the engine crankshaft. Consequently, eight complete revolutions of the crankshaft occur before the sequence restarts. The smoke prevention function which limits the maximum skip firing table pointer to Table 2 restricts the system to either an 8 cylinder sequence or a 16 cylinder sequence, i.e., to either Table 2 or Table 1 firing sequences. Thus, if smoke or excess exhaust emission is a problem, the engine will not be allowed to skip fire except in an 8 cylinder sequence.

The skip firing function also implements a cold engine bog prevention function as shown by block 76 by checking coolant temperature and speed and limiting the skip firing table pointer if coolant temperature is less than a preselected value, such as, for example 140° Fahrenheit. In block 76, a comparison is made to determine if coolant temperature is less than 140° Fahrenheit and speed is less than 250 RPM for one second, and if so, the maximum skip firing table pointer is limited to Table 2 until coolant temperature is greater than 140° Fahrenheit. This function in block 76 thus limits the firing sequence to either a 16 cylinder or an 8 cylinder sequence, i.e., Tables 1 or 2.

The portion of the skip firing program illustrated in block 78 is a calculation to determine whether or not skip firing is actually needed. One of the measures is to determine the actual fuel value set for the engine and the horsepower being produced. The fuel value is compared to a fuel instability value which represents the maximum amount of fuel that can be supplied for skip firing. If fuel value is greater than the fuel instability point and the horsepower being generated is greater than some preselected level, such as, for example, 500 horsepower, for at least ten seconds, then the skip firing table pointer is limited to Table 1 requiring that all 16 cylinders fire. If the measured horsepower drops below 400 horsepower for one second, the skip firing table pointer is then allowed to go to Table 2 for the first 30 seconds and, if the horsepower doesn't increase, then can drop down to Table 3 for the next 30 seconds. Finally, if the measured horsepower drops below 200 for one second, then the skip firing table pointer transitions to Table 4. What is illustrated in block 78 is the decision block for determining whether or not to implement skip firing and is based upon the measured horsepower and preselected horsepower values. Note also that there is a hysteresis block 80 which receives the fuel value signal and adds some degree of hysteresis to the switch point so that the system does not hunt back and forth between different cylinder sequences as a function of the fuel value command.

The skip firing program also implements a normal engine bog prevention function (block 82) by comparing desired speed and actual speed. In the illustrative embodiment, if desired speed is greater than 300 RPM and the actual speed is less than 250 RPM for one second, then the skip firing table pointer decrements by 1. For example, if the engine were operating under Table 4 conditions, a drop in engine speed could cause the system to force operation under Table 3 conditions by decrementing the table pointer by 1. The table pointer is then not allowed to increment for at least 10 seconds. It will be recognized that the values of RPM and time are by way of example only and not intended to be the only selectable values. If the drop in engine speed is more severe, e.g., to less than 225 RPM with a 300 RPM speed command, then the program may decrement the table pointer by 2, i.e., from Table 4 to Table 2 or Table 3 to Table 1. The time limit for incrementing is also used for this 2 table decrementing.

Skip firing also involves computing a fuel limit value that is different than the basic fuel limit value illustrated and described in FIG. 2. In particular, in block 84, the program calculates a skip firing fuel limit value per cylinder which can adjust the fuel limit value to allow more fuel to be injected into a cylinder under skip firing. In particular, the measured engine horsepower is converted to horsepower per cylinder and supplied to a look-up table illustrated as graph 86 whose output is a skip firing efficiency value. A signal representative of engine speed (RPM) is used in a second look-up table illustrated by graph 88 to obtain a value of nominal engine efficiency. Block 92 represents division of nominal efficiency by skip firing efficiency to obtain an efficiency factor. Block 84 shows calculation of a skip firing fuel limit value SFFL by multiplication of the efficiency factor by a skip firing factor and the fuel limit value. Note that the skip firing factor is obtained from table 94 and is the same value as the table pointer, e.g., if firing is in accordance with Table 4, the skip firing factor is also 4.

The enable cylinder commands are provided in response to the portion of the skip firing program which implements the skip firing tables. More particularly, if Table 4 is selected in the manner described above, enable cylinder signals are applied at appropriate times to fuel injection controls for cylinders 1R-7R-8R-2R in one cam shaft revolution, with the pattern of enable cylinder signals on subsequent cam shaft revolutions following the indicated sequences. Selective energization of fuel injection controls is well known in the engine art and, as illustrated, typically requires energization of fuel control solenoids.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed:

1. A method of selectively operating a high-horsepower diesel engine in a skip firing mode under low power conditions, the engine having a plurality of individually controllable, fuel injected cylinders, the method comprising the steps of:

sensing low horsepower and low fuel demand operation of the engine; and selecting a skip firing pattern of cylinders to be fired during each revolution of the engine shaft based upon the sensed fuel demand and engine horsepower, the selected pattern changing the cylinders fired during any one revolution of the engine shaft so that all cylinders are fired within a preselected number of shaft revolutions.

2. The method of claim 1 wherein the pattern of fired cylinders is varied as a function of engine operating parameters so as to maintain exhaust emissions below a preselected level.

3. The method of claim 1 and including the step of varying the pattern of fired cylinders so as to maintain engine operating temperature.

4. The method of claim 1 and including the step of varying the pattern of fired cylinders as a function of engine speed.

5. The method of claim 2 wherein the step of selecting includes the step of comparing actual engine air-fuel ratio to a desired air-fuel ratio and limiting the number of cylinders not fired during each shaft revolution until the actual air-fuel ratio is greater than the desired air-fuel ratio.

6. The method of claim 1 wherein the step of selecting includes the steps of:

measuring engine horsepower; and comparing the measured horsepower to a first selected value and inhibiting skip firing if measured horsepower is greater than the first selected value and fuel demand is above a fuel instability point.

7. The method of claim 6 and including the further step of:

comparing measured horsepower to other selected values and instituting skip firing when measured horsepower is less than at least one of the other values.

8. The method of claim 7 and including a plurality of skip firing patterns and wherein the step of instituting skip firing includes selecting one of the plurality of patterns as a function of measured horsepower.

9. The method of claim 8 and including the step of increasing the number of cylinders fired during each shaft revolution when engine speed drops below desired speed.

10. The method of claim 1 wherein the step of selecting includes the step of inhibiting fuel injection to selected cylinders during each shaft revolution.

11. A system for selectively operating a high-horsepower diesel engine in a skip firing mode under low power conditions, the engine having a fuel system comprising a plurality of individually controllable, fuel injected cylinders, comprising:

means for sensing low horsepower and low fuel demand operation of the engine; and means for selecting a skip firing pattern of cylinders to be fired during each revolution of the engine shaft based upon the sensed fuel demand and engine horsepower, the selected pattern changing the cylinders fired during any one revolution of the engine shaft so that all cylinders are fired within a preselected number of shaft revolutions.

12. The system of claim 11 wherein the pattern of fired cylinders is varied as a function of engine operating parameters so as to maintain exhaust emissions below a preselected level.

13. The system of claim 11 wherein the pattern of fired cylinders is varied so as to maintain engine operating temperature.

14. The system of claim 11 wherein the pattern of fired cylinders is varied as a function of engine speed.

15. The system of claim 12 wherein the means for selecting compares actual engine air-fuel ratio to a desired air-fuel ratio and limits the number of cylinders not fired during each shaft revolution until the actual air-fuel ratio is greater than the desired air-fuel ratio.

16. The system of claim 12 wherein the means for selecting:

measures engine horsepower and compares the measured horsepower to a first selected value and inhibits skip firing if measured horsepower is greater than the first selected value and fuel demand is above a fuel instability point.

17. The system of claim 16 wherein the means for selecting:

compares measured horsepower to other selected values and institutes skip firing when measured horsepower is less than at least one of the other values.

18. The system of claim 16 comprising a plurality of skip firing patterns and wherein the means for selecting selects one of the plurality of patterns as a function of measured horsepower.

19. The system of claim 18 wherein the number of cylinders fired is increased during each shaft revolution when engine speed drops below desired speed.

20. The system of claim 11 wherein the means for selecting inhibits fuel injection to selected cylinders during each shaft revolution.

* * * * *